US008567606B2

(12) United States Patent
Bellamah et al.

(10) Patent No.: US 8,567,606 B2
(45) Date of Patent: Oct. 29, 2013

(54) BOOK-LIKE PACKAGING STRUCTURE FOR RECEIVING A BLISTER PACK

(75) Inventors: Stephen J. Bellamah, Midlothian, VA (US); Dominic Howard, New Canaan, CT (US)

(73) Assignee: Philip Morris USA Inc., Richmond, VA (US)

( * ) Notice: Subject to any disclaimer, the term of this patent is extended or adjusted under 35 U.S.C. 154(b) by 284 days.

(21) Appl. No.: 12/687,446

(22) Filed: Jan. 14, 2010

(65) Prior Publication Data

US 2010/0264153 A1 Oct. 21, 2010

Related U.S. Application Data

(60) Provisional application No. 61/144,502, filed on Jan. 14, 2009.

(51) Int. Cl.
*B65D 83/04* (2006.01)

(52) U.S. Cl.
USPC ..... 206/531; 206/534; 206/539; 206/462

(58) Field of Classification Search
USPC ..... 206/531, 532, 538, 539, 528, 232, 206/387.13; 53/453, 452, 454, 467, 473, 53/475
See application file for complete search history.

(56) References Cited

U.S. PATENT DOCUMENTS

| | | | | |
|---|---|---|---|---|
| 5,542,235 | A | 8/1996 | Konstandin | |
| 5,695,063 | A | 12/1997 | Roulin et al. | |
| 5,788,974 | A | 8/1998 | D'Amico et al. | |
| 6,024,222 | A * | 2/2000 | Friberg et al. | 206/531 |
| 7,000,768 | B2 * | 2/2006 | Morita et al. | 206/531 |
| 7,726,485 | B2 * | 6/2010 | Brollier | 206/534 |
| 7,866,476 | B2 * | 1/2011 | McGonagle et al. | 206/535 |
| 2004/0026293 | A1 | 2/2004 | Hughes | |
| 2004/0188315 | A1 | 9/2004 | Morita et al. | |
| 2006/0042988 | A1 | 3/2006 | Hjalmarsson | |
| 2007/0017847 | A1 | 1/2007 | Leifeld | |
| 2007/0068844 | A1 * | 3/2007 | Weston | 206/538 |

FOREIGN PATENT DOCUMENTS

| | | |
|---|---|---|
| CA | 2 202 733 | 10/1998 |
| DE | 44 29 503 A1 | 2/1996 |

* cited by examiner

*Primary Examiner* — Mickey Yu
*Assistant Examiner* — Chun Cheung
(74) *Attorney, Agent, or Firm* — Roberts Mlotkowski Safran & Cole, P.C.

(57) ABSTRACT

A book-like packaging structure for receiving at least one blister pack having at least one receptacle. The book-like packaging structure includes at least one inner blister pack retainer for receiving the at least one blister pack, the at least one inner blister pack retainer having an inner edge, an outer edge, a first retainer portion and a second retainer portion, said second retainer portion adjacent an inner spine panel having a width equal to or greater than the depth of the at least one receptacle; and a cover for enclosing the at least one inner blister pack retainer, the cover having a first cover portion having an inner edge, a second cover portion having an inner edge and a spine, the spine joined to the inner edge of the first cover portion and the inner edge of the second cover portion, wherein the inner spine panel rests against the spine such that the inner edge of the at least one inner blister pack retainer is positioned adjacent to the spine of the cover. A method of making a book-like packaging structure is also provided.

18 Claims, 3 Drawing Sheets

BOOK-LIKE PACKAGING STRUCTURE FOR RECEIVING A BLISTER PACK

RELATED APPLICATIONS

This patent application claims the benefit of Application Ser. No. 61/144,502, filed on Jan. 14, 2009, directed to a book-like packaging structure for receiving at least one blister pack, which is hereby incorporated by reference in its entirety.

FIELD

This document relates generally to packaging for use with blister packs and, more particularly, to packaging for use with blister packs that contain a plurality of tablets, such as smokeless compressed tobacco products.

WORKING ENVIRONMENT

Recently, new forms of smokeless tobacco products have entered the market place or have been described, including products in the form of gels, films and tablets. Designing packaging for use with a smokeless tobacco product in the form of a tablet provides unique challenges. For example, with tobacco-based products, moisture content can become an issue, since tobacco is, by its nature, hygroscopic. Child-resistance is also another desirable property for packaging used with a smokeless tobacco product.

In the packaging of tablets for distribution to consumers, blister packs are frequently utilized. In particular, when dispensing pharmaceutical or certain other consumer products, blister packaging is generally favored over loose or bottled tablets, for certainty in quantity dispensed, security of storage and convenience of use.

Blister packs may be formed by molding a thin sheet of synthetic plastic or laminate material into a multi-pocket or compartment tray-like structure. This may be undertaken continually on-line followed by a filling and closure operation.

The pockets or compartments are commonly disposed in a rectangular grid array. An individual pocket may be intended to contain a single item. Pocket contents may be accessed at random, or, in certain instances, in a prescribed sequence. A peripheral upstanding rim, ledge or ridge may be incorporated, to help stiffen the overall tray profile and further protect the contents of the compartments.

Blister packs may be formed by molding resiliently deformable synthetic plastics, such as polyvinyl chloride (PVC) or aluminum laminates, such as polyamide/aluminum/PVC, with a pre-configured array of multiple discrete pockets or blisters.

A tablet is captured or restrained within the pockets by a releasable, removable or frangible backing layer, may be produced from a metal, such as aluminum foil, metalized plastics foil, or a laminated paper and foil combination. In a laminated paper and foil combination, the paper is adhesively bonded in a laminated, multi-ply, overlay to the foil, and used as a lift-off release layer. As such, the paper is intended to protect the underlying foil while the paper is in place. To that end, the paper is bonded to the foil, and is not otherwise secured to the blister pack itself.

As may be appreciated, given their construction, blister packs, and the intentionally frangible backing foil layer are vulnerable to inadvertent impact or abrasion contact damage and consequent unintentional pack rupture and attendant product fracture, fragmentation, or displacement and loss.

Thus folding, creasing or crushing, such as may arise by carrying a foil-backed blister in the pocket, can lead to content contamination, displacement and loss altogether. Similarly, casual handling by an inquisitive child can enable accidental content access and the risk of consumption.

To address these issues, blister packs may be sometimes combined with another packaging element, such as a wallet, envelope, pocket, pouch, wrap or shroud. The other packaging element may also provide space for the addition of information and user instructions to meet regulatory requirements or the like. Such an additional packaging element may prove convenient for personal storage in garment pockets, handbags, purses or wallets.

U.S. Patent Publication No. 2004/0026293 proposes a blister pack folded wallet that has a mounting card a hinged spine segment, and an adhesive edge strip. Child resistance is said to be available through cover latching and/or paper reinforced foil laminate, with through apertures and perforations for selective localized paper patch removal over individual blister pockets.

U.S. Patent Publication No. 2004/0188315 proposes a press-through packaging case that includes a case body having first and second sheet members that are overlapped to each other so as to place a press-through package therebetween. The press-through packaging has at least one blister each containing one or more pills. The first sheet member has at least one elongated hole, through which the at least one blister protrudes to the outside, so that the at least one blister is pressed along the at least one elongated hole. The second sheet member proposed has at least one take-out portion located facing to the at least one elongated hole at such a position as to be matched in position to the at least one blister of the press-through package when the press-through package has been slid to a predetermined point.

U.S. Patent Publication No. 2004/0026293 proposes a blister pack case that includes a first case half and a second case half. The halves are hinged on one another. The first case half has a pocket for receiving the blister pack and has an outer part and an inner viewing part and also first apertures in the viewing part and second apertures in the outer part. The second case half has a first compartment for receiving a first display means displaying days of the week, and first windows for displaying the days of the week in an inner viewing surface of the second case half in the area of the first compartment.

Despite these advances in the art, there remains a need for improved packaging structures for use with blister packs that contain a plurality of tablets, such as smokeless compressed tobacco products and for methods for making such packaging.

SUMMARY

Disclosed herein are packaging structures for use with blister packs that contain a plurality of tablets and for methods for making such packaging.

In one aspect, provided is a book-like packaging structure for receiving at least one blister pack having at least one receptacle. The book-like packaging structure includes at least one inner blister pack retainer for receiving the at least one blister pack, the at least one inner blister pack retainer having an inner edge, an outer edge, a first retainer portion and a second retainer portion, the second retainer portion adjacent an inner spine panel having a width equal to or greater than the depth of the at least one receptacle, and a cover for enclosing the at least one inner blister pack retainer, the cover having a first cover portion having an inner edge, a second cover portion having an inner edge and a spine, the spine joined to the inner edge of the first cover portion and the inner edge of the second cover portion, wherein the inner spine panel rests against (is positioned adjacent) the spine such that the inner edge of the at least one inner blister pack retainer is positioned adjacent to the spine of the cover.

In one form, the first retainer portion has a plurality of first apertures and the second retainer portion has a plurality of second apertures, the first apertures being at least partially aligned with the second apertures.

In another form, the at least one blister pack includes a plurality of receptacles, the plurality of receptacles positioned within the plurality of first apertures of the first retainer portion and/or the plurality of second apertures of the second retainer portion.

In yet another form, the plurality of receptacles of the at least one blister pack are arranged in at least two columns.

In still yet another form, the first and/or second apertures are oblong in shape.

In a further form, the book-like packaging structure includes a second inner blister pack retainer for receiving a second blister pack, the second inner blister pack retainer having an inner edge, an outer edge, a first retainer portion and a second retainer portion, the inner edge of the second inner blister pack retainer positioned adjacent to the spine of the cover.

In a yet further form, the inner surface of the first cover portion and the second cover portion include a printable region for displaying informational material.

In a still yet further form, the book-like packaging structure is formed from a single cut sheet of stock.

In another aspect, provided is a method of forming a book-like packaging structure for receiving at least one blister pack having at least one receptacle from a sheet of stock. The method includes the steps of cutting the sheet of stock into a size and shape sufficient to form at least a six panel substrate, folding the at least a six panel substrate to form at least one inner blister pack retainer for receiving the at least one blister pack, the at least one inner blister pack retainer having an inner edge, an outer edge, a first retainer portion and a second retainer portion, the second retainer portion adjacent an inner spine panel having a width equal to or greater than the depth of the at least one receptacle, and folding further the at least a six panel substrate to form a cover for enclosing the at least one inner blister pack retainer, the cover having a first cover portion having an inner edge, a second cover portion having an inner edge and a spine, the spine joined to the inner edge of the first cover portion and the inner edge of the second cover portion, wherein the inner spine panel rests against (is positioned adjacent) said spine such that the inner edge of the at least one inner blister pack retainer is positioned adjacent to the spine of the cover.

In one form, the method includes the step of folding the at least a six panel substrate to form a second inner blister pack retainer for receiving a second blister pack.

In another form, the blister pack is adhesively secured to inner surfaces of the at least one inner blister pack retainer.

These and other features will be apparent from the detailed description taken with reference to the accompanying drawings.

BRIEF DESCRIPTION OF THE DRAWINGS

Further explanation may be achieved by reference to the description that follows and the drawings illustrating, by way of non-limiting examples, various forms, wherein.

DETAILED DESCRIPTION

Figure 1:
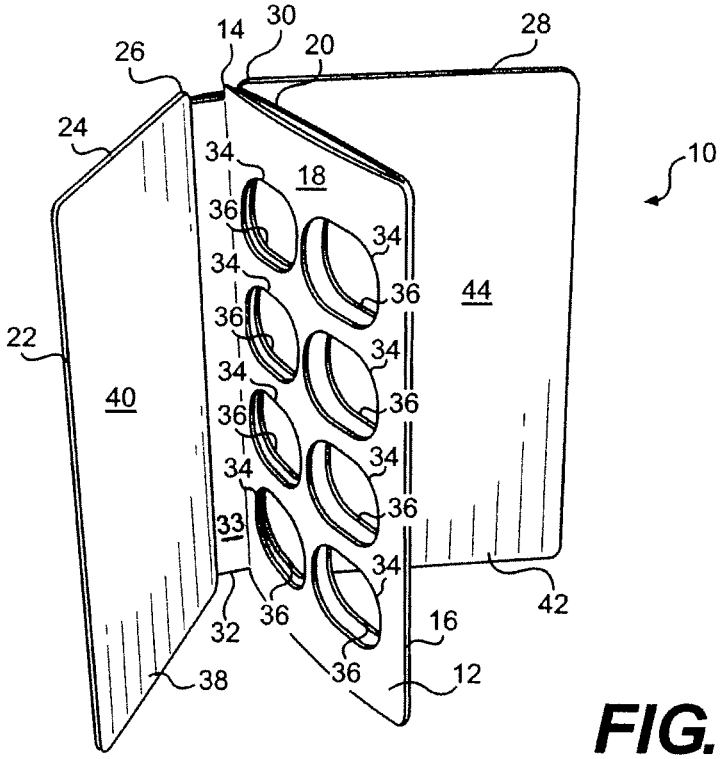
FIG. 1 is a perspective view of a book-like packaging structure, in accordance herewith.

Various aspects will now be described with reference to specific forms selected for purposes of illustration. It will be appreciated that the spirit and scope of the packages and methods disclosed herein are not limited to the selected forms. Moreover, it is to be noted that the figures provided herein are not drawn to any particular proportion or scale, and that many variations can be made to the illustrated forms. Reference is now made to FIGS. 1-5, wherein like numerals are used to designate like elements throughout.

Definitions

The term "blister pack" is used herein to embrace a preformed or pre-configured packaging sheet or layer, for example configured as a shallow tray, pre-profiled with multiple localized compartments or pockets. The individual compartment profile conveniently complements that of the intended contents, to ensure a snug relative fit. The pocket wall affords some resistance to impact, but is typically deformable to allow contents displacement and ejection, and modest cushioning action.

The term "child-resistant" relates to certain measures to impede unauthorized pack opening or access to children, as might otherwise arise by casual or curious handling, as encountered in child play. Such provision represents a precautionary or deterrent measure, rather than necessarily an absolute defense/

The term "tablet" is used in its common context, and refers to a solid composition made by compressing and/or molding a mixture of compositions in a form convenient for buccal application.

Referring to FIGS. 1-4, one form of a book-like packaging structure 10 for receiving at least one blister pack 100 (see FIG. 2), in accordance herewith, is shown. Book-like packaging structure 10 includes at least one inner blister pack retainer 12 for receiving the at least one blister pack 100. As shown, the at least one inner blister pack retainer 12 has an inner edge 14, an outer edge 16, a first retainer portion 18 and a second retainer portion 20. As shown, second retainer portion 20 is positioned adjacent an inner spine panel 33. In one form, inner spine panel 33 has a width equal to or greater than the depth of blister pack receptacles 102 of blister pack 100.

Book-like packaging structure 10 also includes a cover 22 for enclosing the at least one inner blister pack retainer 12. Cover 22 includes a first cover portion 24 having an inner edge 26, a second cover portion 28 having an inner edge 30 and a spine 32 joined to inner edge 26 of first cover portion 24 and inner edge 30 of second cover portion 28. As shown, inner edge 14 of the at least one inner blister pack retainer 12 is positioned adjacent to spine 32 of cover 22. As shown in FIG. 1, inner spine panel 33 rests against and is preferably adhered to spine 32, such that the overall packet structure is orthogonal, much like a small book in a closed condition.

In one form, the first retainer portion 18 of the at least one inner blister pack retainer 12 is provided with a plurality of first apertures 34. Likewise, the second retainer portion 20 of the at least one inner blister pack retainer 12 is provided with a plurality of second apertures 36. As shown in FIG. 1, in one form, the first apertures 34 are at least partially aligned with the second apertures 36.

Figure 2:
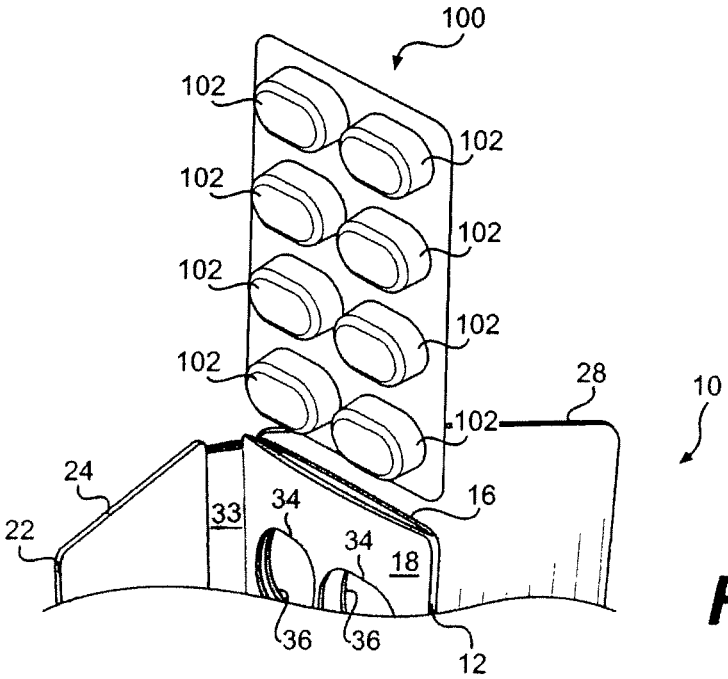
FIG. 2 is a partial perspective view of a book-like packaging structure, showing a blister pack for insertion within the book-like packaging structure.
Figure 3:
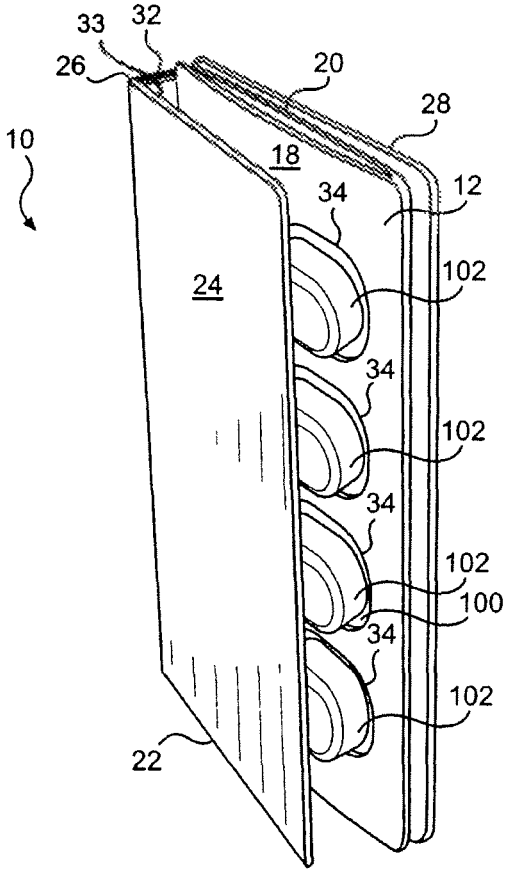
FIG. 3 is a perspective view of a book-like packaging structure having a blister pack inserted within the book-like packaging structure.
Figure 4:
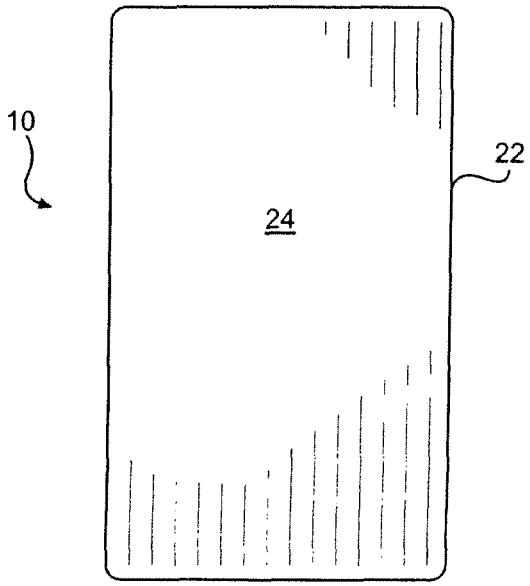
FIG. 4 is a front plan view of a book-like packaging structure, in accordance herewith.

Referring now to FIGS. 2 and 3, in one form, book-like packaging structure 10 includes at least one blister pack 100. Blister pack 100 includes a plurality of receptacles 102. Referring to FIG. 3, each receptacle 102 containing a tablet (not shown). In one form, when installed within the at least one inner blister pack retainer 12 the plurality of receptacles 102 are positioned within the plurality of first apertures 34 of first retainer portion 18 and/or the plurality of second apertures 36 of second retainer portion 20 of book-like packaging structure 10.

In one form, the plurality of receptacles 102 of the at least one blister pack 100 are arranged in at least two columns. As shown in FIGS. 2 and 3, are oblong in their configuration. Referring again to FIG. 1, it may be seen that plurality of first apertures 34 of first retainer portion 18 and/or the plurality of second apertures 36 of second retainer portion 20 of book-like packaging structure 10 are also oblong to conform to the plurality of receptacles 102. As may be appreciated, first apertures 34 of first retainer portion 18 and second apertures 36 may be aligned, one accommodating the receptacles 102, the other for product discharge. In one form, book-like packaging structure 10 is configured to allow product discharge without removing blister pack 100.

In another form, the book-like packaging structure 10 also includes a second inner blister pack retainer 12 for receiving a second blister pack 100. Second inner blister pack retainer 12 also has an inner edge 14, an outer edge 16, a first retainer portion 18 and a second retainer portion 20. Inner edge 14 of the second inner blister pack retainer 12 is also positioned adjacent to spine 32 of cover 22.

In one form, the first retainer portion 18 of the second inner blister pack retainer 12 is provided with a plurality of first apertures 34. Likewise, the second retainer portion 20 of the second inner blister pack retainer 12 is provided with a plurality of second apertures 36. In one form, the first apertures 34 are at least partially aligned with the second apertures 36.

As may be appreciated, the book-like packaging structures disclosed herein provide a greater amount of surface area for the printing of graphics and product information. Referring again to FIGS. 1 and 2, in one form, an inner surface 38 of first cover portion 24 is provided with a printable region 40 for displaying informational material. In another form, an inner surface 42 of second cover portion 28 is provided with a printable region 44 for displaying informational material.

Figure 5:
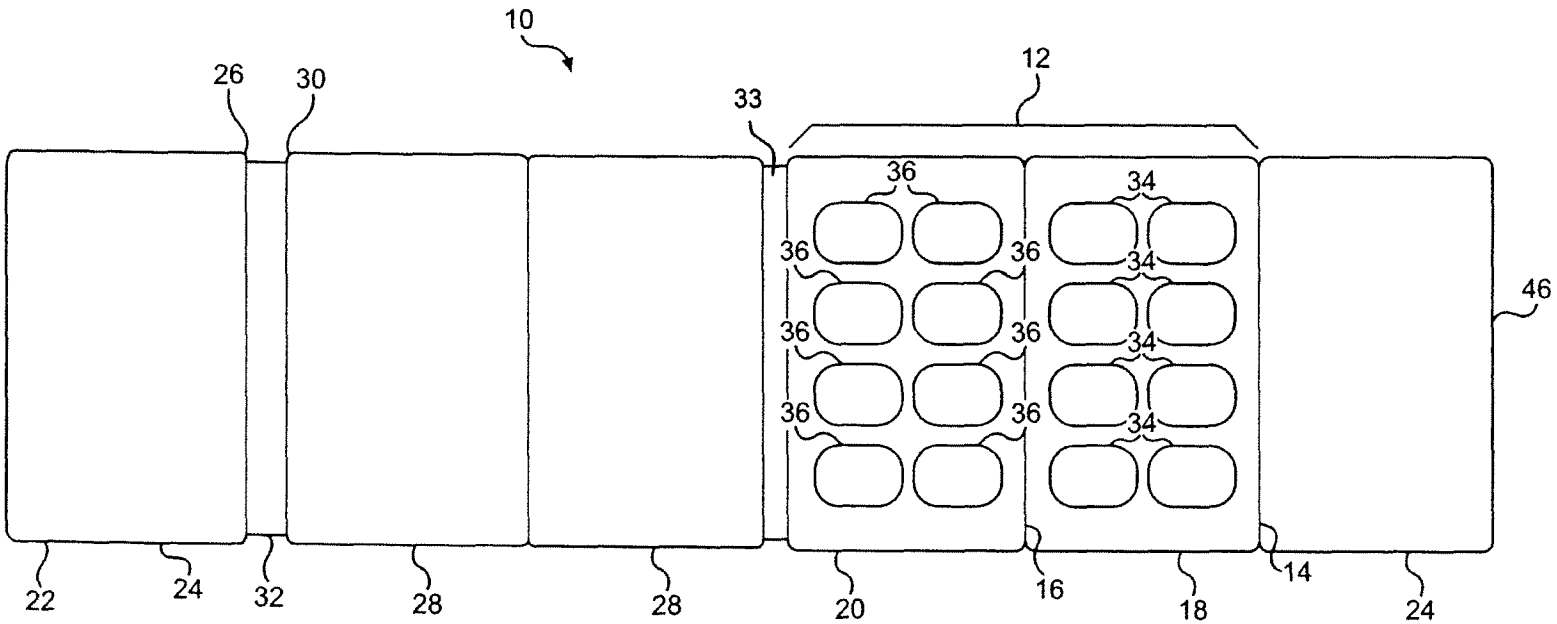
FIG. 5 depicts a lay flat view of a substrate for use in forming a book-like packaging structure, in accordance herewith.

As shown in FIG. 5, book-like packaging structure 10 is formed from a single cut sheet of stock. In another aspect, provided is a method of forming a book-like packaging structure 10 from a sheet of stock. The method disclosed herein includes the steps of cutting the sheet of stock into a size and shape sufficient to form at least a six panel substrate 46. The at least a six panel substrate 46 is then folded to form at least one inner blister pack retainer 12 for receiving the at least one blister pack 100 (see FIG. 2). The at least one inner blister pack retainer 12 is folded to create an inner edge 14 and an outer edge 16 from the first retainer portion 18 and the second retainer portion 20.

Still referring to FIG. 5, an edge of second retainer portion 20 adjoins inner spine panel 33. As is preferred, inner spine panel may have a width equal to, or slightly greater than, the depth of receptacles 102 of blister pack 100.

The at least a six panel substrate 46 is folded further to form a cover 22 for enclosing the at least one inner blister pack retainer 12. The cover 22 has a first cover portion 24 having an inner edge 26, a second cover portion 28 having an inner edge 30 and a spine 32. Spine 32 is integrally joined to inner edge 26 of first cover portion 24 and inner edge 30 of second cover portion. Book-like packaging structure 10 is folded so that inner edge 14 of the at least one inner blister pack retainer 12 is positioned adjacent to spine 32 of cover 22.

Prior to the folding steps referred to above, in one form, a plurality of first apertures 34 are formed within the first retainer portion 14 and a plurality of second apertures 36 within the second retainer portion 20. In another form, the first apertures 34 are formed so as to be at least partially aligned with the second apertures 36, when first retainer portion 18 is folded onto second retainer portion 20.

In assembly, blister pack 100 is placed onto an inner surface of either first retainer portion 14 or second retainer portion 20 prior to folding. An adhesive may be employed to fix blister pack 100 in place. As may be appreciated, in one form, the plurality of receptacles 102 of blister pack 100 are placed within the plurality of first apertures 34 of first retainer portion 18 or the plurality of second apertures 34 of second retainer portion 20 of at least one inner blister pack retainer 12. As indicated above, upon assembly of book-like packaging structure 10, inner spine panel 33 rests against and is preferably adhered to spine 32, such that the overall packet structure is orthogonal (rectanguloid), much like a small book in a closed condition.

Substrate 46 may be made from cardboard stock that is relatively thick and stiff, a paper (pulp and fiber) product or other substitute materials, such as synthetic plastics and multi-layer composites, as those skilled in the art will plainly recognize.

In another form, at least an eight panel substrate (not shown) is folded to form a second inner blister pack retainer 12 for receiving a second blister pack 100, the second inner blister pack retainer 12 having an inner edge 14, an outer edge 16, a first retainer portion 18 and a second retainer portion 20. As above, the inner edge 14 of the second inner blister pack retainer 12 is positioned adjacent to spine 32 of cover 22.

Referring again to FIGS. 2 and 3, blister pack 100 may be formed by molding a resiliently deformable synthetic plastic, such as polyvinyl chloride (PVC) or, alternatively, an aluminum laminate, such as a polyamide/aluminum/PVC shell, with a pre-configured array of multiple discrete receptacles 102 or blisters.

As may be appreciated, a tablet (not shown) is captured or restrained within receptacles 102, by a releasable, removable or frangible backing layer 104, typically produced from a metal, such as aluminum foil, metalized plastics foil, or a laminated paper and foil combination. In a laminated paper and foil combination, the paper is adhesively bonded in a laminated, multi-ply, overlay to the foil, and used as a lift-off release layer. As such, the paper is intended to protect the underlying foil while the paper is in place. To that end, the paper is bonded to the foil, and is not otherwise secured to the blister pack 100 itself.

In practice, the foil is fused, by heat welding, such as by a heated profiled platen, to the receptacle 102, except for certain localized areas, such as at the edges, which serve as a backing paper lift-off point for paper separation and removal from the foil. The paper overlay effectively obscures the foil and impedes piecemeal foil and receptacle separation.

Generally, the paper layer constitutes a tamper-resistant and child-resistant layer to prevent casual blister pack content discharge, such as through inquisitive handling and experimentation. Once the paper overlay is peeled back from the foil underlay, over a selected tablet receptacle of the blister pack, foil puncture is allowed.

To assist localized peeling of the protective paper backing layer, it is known to apply a matrix or grid of perforations, say, upon pack fabrication and assembly. Thus local removal of a paper backing cover portion overlying a particular receptacle and local exposure of foil overlying that pocket, allows content displacement and ultimate ejection, upon foil tearing or rupture, by depressing the relevant resiliently deformable blister receptacle wall.

As may be appreciated, machines dedicated to blister pack production that are capable of high speed operation are envisioned for use in the production of blister pack 100.

As indicated, book-like packaging structure 10 may advantageously be employed to package a plurality of dissolvable compressed tobacco products that are adapted to be consumed orally. Compressed tobacco products of this type are disclosed in Provisional Application Ser. No. 60/990,661, the contents of which are hereby incorporated for all that they disclose. Such compressed tobacco products are formed from a composition that includes at least one tobacco component, at least one flavorant, at least one sweetener, at least one filler-binder, at least one lubricant; at least one desiccant and a glidant. The outer surfaces of the compressed tobacco products packaged within book-like packaging structure 10 may optionally be coated, treated, embossed or debossed and, in the case of a blister pack 100 having transparent receptacles 102, such surface characteristics may be readily apparent to the consumer.

Advantageously, book-like packaging structure 10 is designed to be capable of high speed assembly, and employ the attendant machines and processes associated therewith.

All patents, test procedures, and other documents cited herein, including priority documents, are fully incorporated by reference to the extent such disclosure is not inconsistent with this disclosure and for all jurisdictions in which such incorporation is permitted.

While the illustrative embodiments disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside herein, including all features which would be treated as equivalents thereof by those skilled in the art to which the disclosure pertains.

What is claimed is:

1. A book-like packaging structure for receiving at least one blister pack having at least one receptacle, comprising:

a) at least one inner blister pack retainer for receiving the at least one blister pack, said at least one inner blister pack retainer comprising first and second retainer portions each having an inner edge and an opposite outer edge, said first and the second retainer portions joined at their respective outer edges, said inner edge of said first retainer portion joined to an inner spine panel having a width equal to or greater than a depth of the at least one receptacle, and said inner edge of said second retainer portion adjacent to said inner spine panel; and b) a cover for enclosing said at least one inner blister pack retainer, said cover having a first cover portion having an inner edge, a second cover portion having an inner edge and a spine, said spine joined to said inner edge of said first cover portion and said inner edge of said second cover portion, wherein said inner spine panel is positioned adjacent said spine such that said inner edge of said at least one inner blister pack retainer is positioned adjacent to said spine of said cover, wherein said at least one inner blister pack retainer forms at least one page positioned between said first cover portion and said second cover portion to form the book-like packaging structure, wherein said first and second cover portions are disposed at opposite sides of said at least one blister pack retainer when said book-like packaging is in a closed condition, and wherein said first retainer portion has a plurality of first apertures and said second retainer portion has a plurality of second apertures, said first apertures being at least partially aligned with the second apertures.

2. The book-like packaging structure of claim 1, wherein the at least one blister pack comprises a plurality of receptacles, each receptacle containing a tablet.

3. The book-like packaging structure of claim 2, wherein the plurality of receptacles are positioned within the plurality of first apertures of said first retainer portion and/or the plurality of second apertures of said second retainer portion.

4. The book-like packaging structure of claim 3, wherein the plurality of receptacles are arranged in at least two columns.

5. The book-like packaging structure of claim 3, wherein the first and/or second apertures are oblong.

6. The book-like packaging structure of claim 1, further comprising a second inner blister pack retainer for receiving a second blister pack, said second inner blister pack retainer having an inner edge, an outer edge, a first retainer portion and a second retainer portion, said inner edge of said second inner blister pack retainer positioned adjacent to said spine of said cover.

7. The book-like packaging structure of claim 1, wherein an inner surface of said first cover portion comprises a printable region for displaying informational material.

8. The book-like packaging structure of claim 1, wherein an inner surface of said second cover portion comprises a printable region for displaying informational material.

9. The book-like packaging structure of claim 1, wherein the book-like packaging structure is formed from a single cut sheet of cardboard stock.

10. A method of forming a book-like packaging structure for receiving at least one blister pack having at least one receptacle from a sheet of stock, the method comprising the steps of:

a) cutting the sheet of stock into a size and shape sufficient to form at least a six panel substrate;

b) folding the at least a six panel substrate to form at least one inner blister pack retainer for receiving the at least one blister pack, the at least one inner blister pack retainer having an inner edge, an outer edge, a first retainer portion and a second retainer portion, the second retainer portion adjacent an inner spine panel having a width equal to or greater than the depth of the at least one receptacle;

c) creating a plurality of first apertures within the first retainer portion and creating a plurality of second apertures within the second retainer portion, the first apertures being at least partially aligned with the second apertures, and d) folding further the at least a six panel substrate to form a cover for enclosing the at least one inner blister pack retainer, the cover having a first cover portion having an inner edge, a second cover portion having an inner edge and a spine, the spine joined to the inner edge of the first cover portion and the inner edge of the second cover portion, wherein the inner spine panel is positioned adjacent the spine such that the inner edge of the at least one inner blister pack retainer is positioned adjacent to the spine of the cover, wherein said at least one inner blister pack retainer forms at least one page positioned between said first cover portion and said second cover portion to form the book-like packaging structure, wherein said first and second cover portions are disposed at opposite sides of said at least one blister pack retainer when said book-like packaging is in a closed condition.

11. The method of claim 10, wherein the at least one blister pack comprises a plurality of receptacles, each receptacle containing a tablet.

12. The method of claim 11, further comprising the step of positioning the plurality of receptacles within the plurality of first apertures of the first retainer portion and/or the plurality of second apertures of the second retainer portion.

13. The method of claim 12, wherein the plurality of receptacles are arranged in at least two columns.

14. The method of claim 12, wherein the first and/or second apertures are oblong.

15. The method of claim 10, further comprising the step of folding the at least a six panel substrate to form a second inner blister pack retainer for receiving a second blister pack, the second inner blister pack retainer having an inner edge, an outer edge, a first retainer portion and a second retainer portion, the inner edge of the second inner blister pack retainer positioned adjacent to the spine of the cover.

16. The method of claim 10, further comprising the step of providing an inner surface of the first cover portion with a printable region for displaying informational material.

17. The method of claim 10, further comprising the step of providing an inner surface of the second cover portion with a printable region for displaying informational material.

18. The method of claim 10, wherein the blister pack is adhesively secured to inner surfaces of the at least one inner blister pack retainer.

* * * * *